US008499834B2

(12) United States Patent
Guidry et al.

(10) Patent No.: US 8,499,834 B2
(45) Date of Patent: Aug. 6, 2013

(54) MILLING TOOL FOR ESTABLISHING OPENINGS IN WELLBORE OBSTRUCTIONS

(75) Inventors: Christopher W. Guidry, Spring, TX (US); Guruswami Navin, Houston, TX (US); Lambertus C. F. Joppe, Vlierden (NL); Andrew D. Ponder, Houston, TX (US); Calvin Stowe, Bellaire, TX (US)

(73) Assignee: Baker Hughes Incorporated, Houston, TX (US)

( * ) Notice: Subject to any disclaimer, the term of this patent is extended or adjusted under 35 U.S.C. 154(b) by 344 days.

(21) Appl. No.: 12/896,266

(22) Filed: Oct. 1, 2010

(65) Prior Publication Data

US 2011/0240367 A1 Oct. 6, 2011

(51) Int. Cl.

| | |
|---|---|
| ***E21B 29/06*** | (2006.01) |
| ***E21B 17/10*** | (2006.01) |
| ***E21B 10/26*** | (2006.01) |

(52) U.S. Cl.

USPC ..... 166/298; 166/55.6; 166/317; 166/376; 175/385; 175/391; 175/408

(58) Field of Classification Search

USPC ..... 166/298, 376, 55.6, 317; 175/57, 175/385, 391, 408

See application file for complete search history.

(56) References Cited

U.S. PATENT DOCUMENTS

| | | | | |
|---|---|---|---|---|
| 1,547,459 | A * | 7/1925 | Stafford et al. | 175/384 |
| 1,701,427 | A * | 2/1929 | Shields | 175/391 |
| 1,747,908 | A * | 2/1930 | Seifert | 175/334 |
| 2,124,414 | A * | 7/1938 | Goldman | 175/334 |
| 2,149,798 | A * | 3/1939 | Starkey | 175/391 |
| 2,607,562 | A * | 8/1952 | Phipps | 175/391 |
| 4,350,204 | A * | 9/1982 | Horton | 166/175 |
| 4,452,307 | A * | 6/1984 | Horton | 166/174 |
| 5,407,011 | A * | 4/1995 | Layton | 166/376 |
| 6,109,347 | A * | 8/2000 | Ferguson et al. | 166/55.7 |
| 7,100,713 | B2 * | 9/2006 | Tulloch | 175/402 |
| 7,178,609 | B2 * | 2/2007 | Hart et al. | 175/61 |
| 7,363,992 | B2 | 4/2008 | Stowe et al. | 175/426 |
| 7,370,702 | B2 | 5/2008 | Stowe | 166/298 |
| 7,373,983 | B2 * | 5/2008 | McGavern et al. | 166/296 |
| 7,810,568 | B2 * | 10/2010 | Toulouse | 166/298 |
| 8,042,613 | B2 * | 10/2011 | Hallundbaek et al. | 166/297 |
| 8,276,688 | B2 * | 10/2012 | Dietz et al. | 175/78 |
| 2003/0089499 | A1 * | 5/2003 | Ohmer | 166/298 |
| 2003/0164251 | A1 * | 9/2003 | Tulloch | 175/57 |
| 2006/0090897 | A1 * | 5/2006 | Stowe et al. | 166/298 |
| 2007/0181305 | A1 * | 8/2007 | McGavern et al. | 166/298 |
| 2008/0245532 | A1 * | 10/2008 | Rhinehart et al. | 166/376 |
| 2010/0012322 | A1 * | 1/2010 | McGarian | 166/298 |
| 2010/0012387 | A1 | 1/2010 | Huynh et al. | 175/428 |
| 2010/0101802 | A1 * | 4/2010 | Hallundbaek et al. | 166/376 |
| 2010/0108402 | A1 | 5/2010 | Ponder et al. | 175/428 |
| 2011/0240367 | A1 * | 10/2011 | Guidry et al. | 175/57 |

* cited by examiner

*Primary Examiner* — Jennifer H Gay

(74) *Attorney, Agent, or Firm* — Shawn Hunter

(57) ABSTRACT

A milling tool which includes a nose cutting portion, a cutting section having a plurality of hardened cutters and a shaft portion. A wear pad is disposed on the cutting section and shaft portion. Upon the shaft portion, the wear pad extends radially outwardly to an engagement diameter that exceeds the maximum cutting diameter of the cutters.

17 Claims, 15 Drawing Sheets

MILLING TOOL FOR ESTABLISHING OPENINGS IN WELLBORE OBSTRUCTIONS

This application claims priority to U.S. Provisional Patent Application Ser. No. 61/247,928 filed Oct. 1, 2009.

BACKGROUND OF THE INVENTION

1. Field of the Invention

The invention relates generally to systems and methods to form an opening by cutting through an obstruction within a wellbore.

2. Description of the Related Art

In the course of wellbore production operations, objects and devices occasionally become undesirably stuck within a production wellbore and are substantially resistant to removal using fishing devices. Such instances might include, for example, when an object, such as a ball valve ball is locked in the closed position such that it cannot be opened using conventional methods. In such instances, the locked closed object is most often generally oriented such that a transverse hole within the object is generally oriented perpendicular to the wellbore.

SUMMARY OF THE INVENTION

The present invention provides a milling tool and a method for using such an apparatus to form an opening in an object, device or other obstruction within a wellbore that includes a transverse hole. The presence of this hole requires the milling tool to bore through curved surfaces at the top and bottom of the hole which presents unique and complex design challenges. The milling tool may be deployed downhole on drill string or on coiled tubing. When deployed on coiled tubing, a mud motor is positioned between the coiled tubing and the milling tool in order to cause the milling tool to rotate.

In a preferred embodiment, the milling tool includes a milling tool body having a sequence of sections of increasing diameter with a nose cutting portion at the distal end, a cutting section, and a shaft portion at the proximal end of the milling tool body. The generally stepped cutting section of the milling tool body preferably presents a series of sections of increased diameters arranged in a step-type fashion. The cutting section presents a plurality of affixed cutters that are designed to contact and bore through an obstruction. In a preferred embodiment, the cutters are secured within cutter pockets that are formed into the milling tool body.

In preferred embodiments, the milling tool includes a plurality of stabilizing wear pads. Preferably, the wear pads are formed of axially extending strips of copper alloy or similar ate al that are located in a specific spaced circumferential relation around the circumference of the milling tool body and are positioned nearly adjacent to the cutters for cutter protection. The pads disposed upon the shaft portion adjacent the cutting portion present a greater engagement diameter along the shaft portion of the milling tool body than the greatest cutting diameter of the cutters. This permits the milling load to be supported and stabilized when the cutters of the final step are completely through the upper solid portion of the obstruction. during cutting operation, these pads wear away.

The milling tool includes an axial fluid flowbore that is in fluid communication with fluid flowing through the running string. Fluid circulation ports extend from the fluid flowbore through the milling tool body. Thus, fluid that is dispersed down through the running string will be circulated out through the circulation ports to flow debris away from the cutters during operation.

In a further feature of the invention, an annular flow through no-go centralizer preferably surrounds a reduced-diameter shaft portion of the milling tool body. The no-go centralizer is preferably rotationally moveable with respect to the milling tool body. The outside diameter of the centralizer as measured around the centralizer ribs is larger than the milling tool body diameter, such that the centralizer ribs present stop shoulders to engage an upper portion of a wellbore obstruction, thereby stopping cutting progress of the milling tool and signaling to an operator that the desired hole has been established.

In operation, the milling tool is used to establish openings through wellbore obstructions and create access to hydrocarbon reservoirs into which access was previously restricted by the obstruction. Though general in intended application, the devices and methods of the present invention are particularly well suited to instances wherein the device must bore through wellbore obstructions, such as closed ball valve balls, which include large diameter holes which are transverse to the boring direction. These applications are particularly challenging as both the top and the bottom of the transverse hole are curved. As this curvature is being bored, the cutters of a given step will bear on the obstruction material during a portion of a given revolution of the milling tool and be unsupported during another portion of the revolution. When the bored hole approaches the transverse hole diameter, the arcs in which the cutters are in contact with the obstruction become small. The cutters must be constantly supported to avoid severe vibration, so an alternative means of supporting the cutters must be provided. In accordance with embodiments of the present invention, when cutters are not supported on the top side of the transverse hole, cutters cutting on the bottom side of the hole are in contact with the obstruction. If the cutters of each step substantially perform their cutting in a plane perpendicular to the milling tool axis, it is not always geometrically possible to keep them supported. Thus, the cutters are angled with respect to the milling tool axis so their contact on the top and bottom of the transverse hole is extended over an appreciable boring distance which enables the milling tool to be designed such that it is supported by the cutters in contact with the obstruction for most of the revolution. Even when the cutters at the top and bottom of the transverse hole are fully supported, angling the cutters provides another important benefit of cutting efficiently with a relatively constant applied cutting load by maintaining an approximately constant cut width. As the cutters at the top enter the transverse hole, their cut width becomes progressively narrower as the boring progresses. Conversely, the cutters engaging the bottom of the hole start with a very narrow cut width at contact, and the width grows progressively as the boring progresses. With proper axial spacing, the width of the bottom cut can increase substantially the same amount as the top cut decreases, providing a substantially constant cut width and milling contact area. In addition, once the cutters have passed entirely through the upper solid portion of the obstruction, the milling tool is stabilized by contact between wear pads and the upper solid portion. Hole cutting devices constructed in accordance with the present invention may be used with through-tubing arrangements. These devices apply an essentially constant cutting load, so designs are provided that will operate effectively at a constant load, thereby offering substantial advantages.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
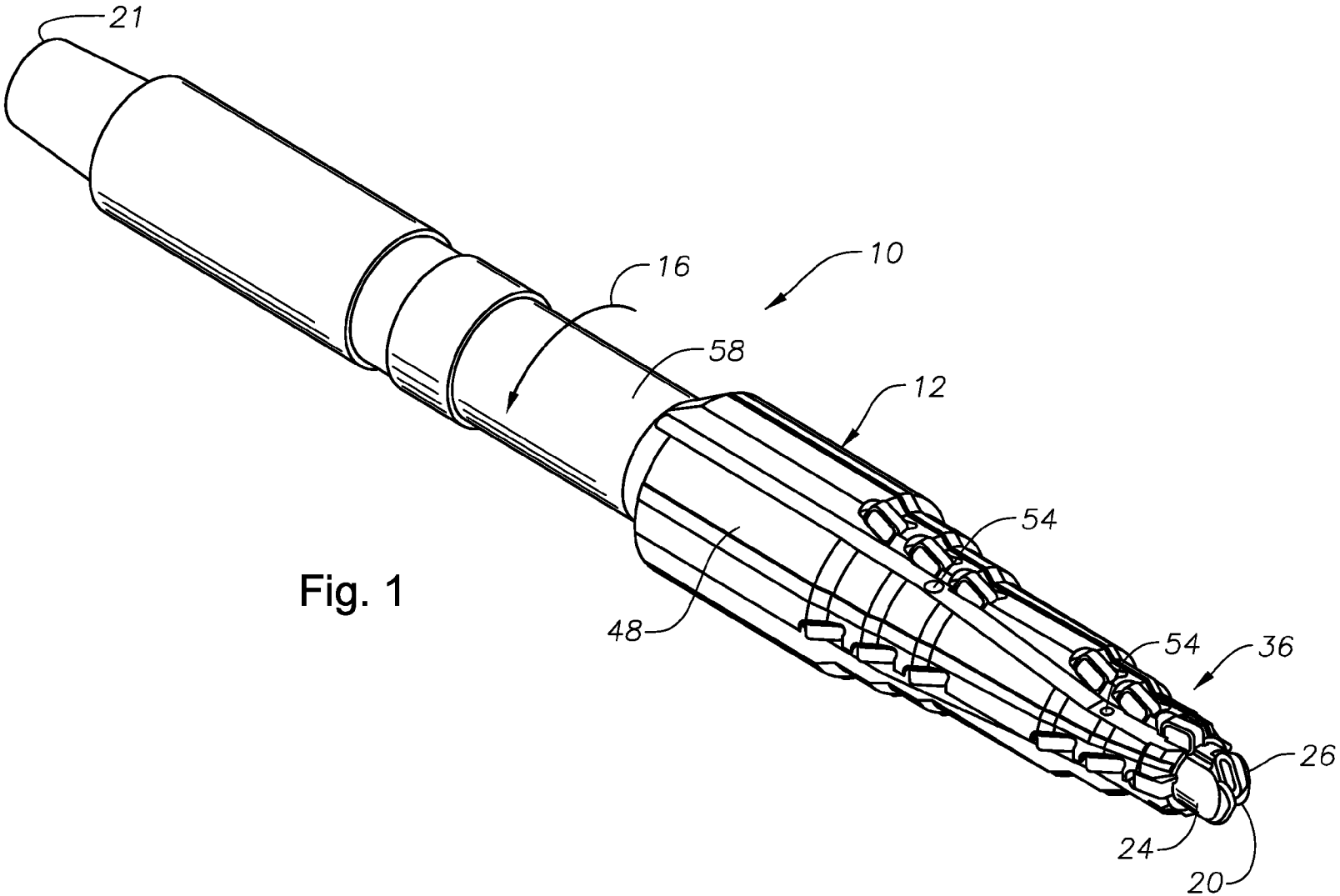
FIG. 1 is an external, isometric view of an exemplary milling tool constructed in accordance with the present invention.

Referring first to FIGS. 1-8, there is depicted an exemplary milling tool 10 that has been constructed in accordance with the present invention. The milling tool 10 includes a milling tool body 12 that has a shaft/fishing neck. In the event that coiled tubing is used for running the milling tool 10, a mud motor of a type known in the art, is positioned in between the coiled tubing and the milling tool 10 in order to cause the milling tool 10 to rotate as fluid is flowed down through the mud motor. During operation in a wellbore, the milling tool 10 is rotated in the direction indicated by arrow 16.

The milling tool body 12 has a distal end 20 and a proximal end 21. The distal end 20 of the milling tool body 12 presents a nose cutting portion, generally indicated at 22. In a preferred embodiment, the nose cutting portion 22 includes a pair of cutting prongs 24, 26, which protrude axially in the distal direction from cylindrical base 27. Each cutting prong 24, 26 has a generally semi-circular cross-section and a gap 28 located between the cutting prongs 24, 26. Hardened nose cutters 30, 32 are affixed to each of the cutting prongs 24, 26, respectively. The nose cutters 30, 32 are preferably formed of carbide or a similar suitably hard substance and may be attached to the prongs 24 or 26 by brazing, as is known in the art. Preferably, the nose cutters 30, 32 have an elongated, generally oblong configuration. The nose cutters 30, 32 may be of the type described in U.S. Pat. No. 7,363,992 entitled "Cutters for Downhole Cutting Devices" and issued to Stowe et al. U.S. Pat. No. 7,363,992 is owned by the assignee of the present invention and is hereby incorporated in its entirety by reference Each of the nose cutters 30, 32 presents a wear face 34. As is apparent from FIGS. 1-3, the nose cutters 30, 32 are mounted in an offset relation to each other such that the wear faces 34 of each are exposed. Additionally, the wear faces 34 of each of the nose cutters 30, 32 are in a facing relation to the other.

Figure 3:
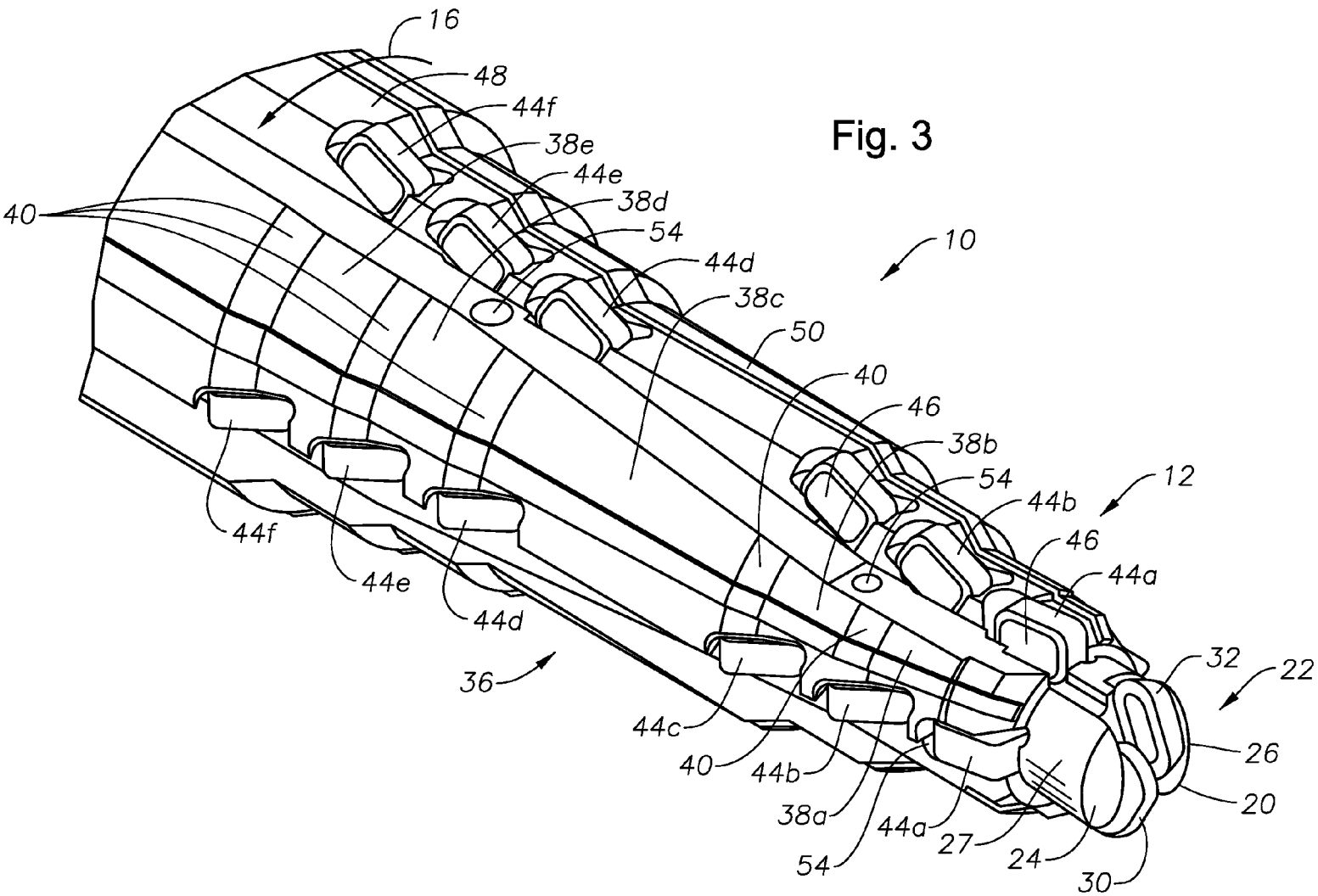
FIG. 3 is an enlarged external isometric view of portions of the exemplary milling tool shown in FIGS. 1 and 2.
Figure 4:
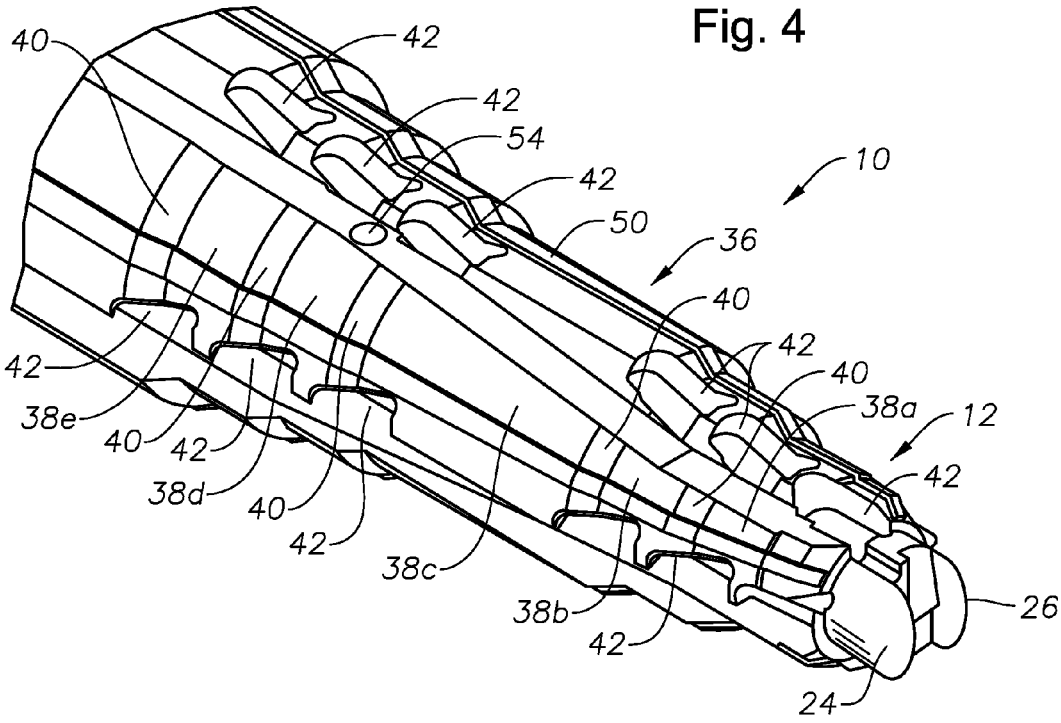
FIG. 4 is an external isometric view of portions of the exemplary milling tool shown in FIGS. 1-3, except with cutters shown removed.

A generally conical cutting section 36 is located adjacent the nose cutting portion 22 on the milling tool body 12 and is preferably integrally formed with the cylindrical section 27 of the nose cutting portion 22. As best shown in FIGS. 3 and 4, the conical cutting section 36 preferably is formed of a plurality of annular portions 38*a*, 38*b*, 38*c*, 38*d*, 38*e* or sequentially increasing diameters. The annular portions 38*a*, 38*b*, 38*c*, 38*d*, 38*e* are separated by angled shoulders 40, resulting in a stepped configuration. It is noted that annular portion 38*c* is axially elongated as compared to the other annular portions 38*a*, 38*b*, 38*d* and 38*e*.

FIG. 4 depicts the milling tool body 12 with no cutters added thereupon and depicts a plurality of cutter pockets 42 that are formed into the cutting section 36. It is noted that the cutter pockets 42 are formed adjacent to each other in an axial line along the cutting section 36. It is also pointed out that there are preferably multiple axial lines of cutter pockets 42 that are arranged in a circumferentially spaced relation about the circumference of the milling tool body 12. In the depicted embodiment, there are four lines of cutter pockets 42 which are angularly separated from one another about the circumference of the cutting section by approximately 90 degrees.

Hardened cutters 44 are affixed within the cutter pockets 42 such that at least three flat sides can be positioned against the cutter pocket walls. The cutters 44 contact the pockets 42 on at least three sides such that their location is fully determined by the pocket 42. The cutters 44 are preferably made of carbide or a similar suitably hard material and may be of the same type as the nose cutters 30, 32 previously described. The cutters 44 may be affixed to the cutter pockets 42 by brazing. As can be seen in FIG. 3, the most distal cutters 44*a* are oriented so that the cutters elongated sides extend in an axial direction parallel to the axis of the milling tool body 12. The remaining cutters 44 are preferably oriented in an angled fashion. The wear faces 46 of the cutters 44 are directed to face in the rotational direction of cutting 16. As illustrated in FIG. 3, the cutters 44 are arranged in cutter rows 44*a*, 44*b*, 44*c*, 44*d*. 44*e* and 44*f*. The cutters 44 in each row will engage and mill an obstruction along the same arc of impact, albeit the cutters 44 in each row could be alternatingly engaged while milling an obstruction inherently possessing a transverse hole. The axially elongated annular portion 38*c* separates cutter rows 44*c* and 44*d*.

The milling tool body 12 also includes an elongated shaft portion 48 that is located proximally from the conical cutting portion 36. The shaft portion 48 provides a section of maximum diameter for the tool 10. There are no cutters 44 located upon the shaft portion 48.

Figure 2:
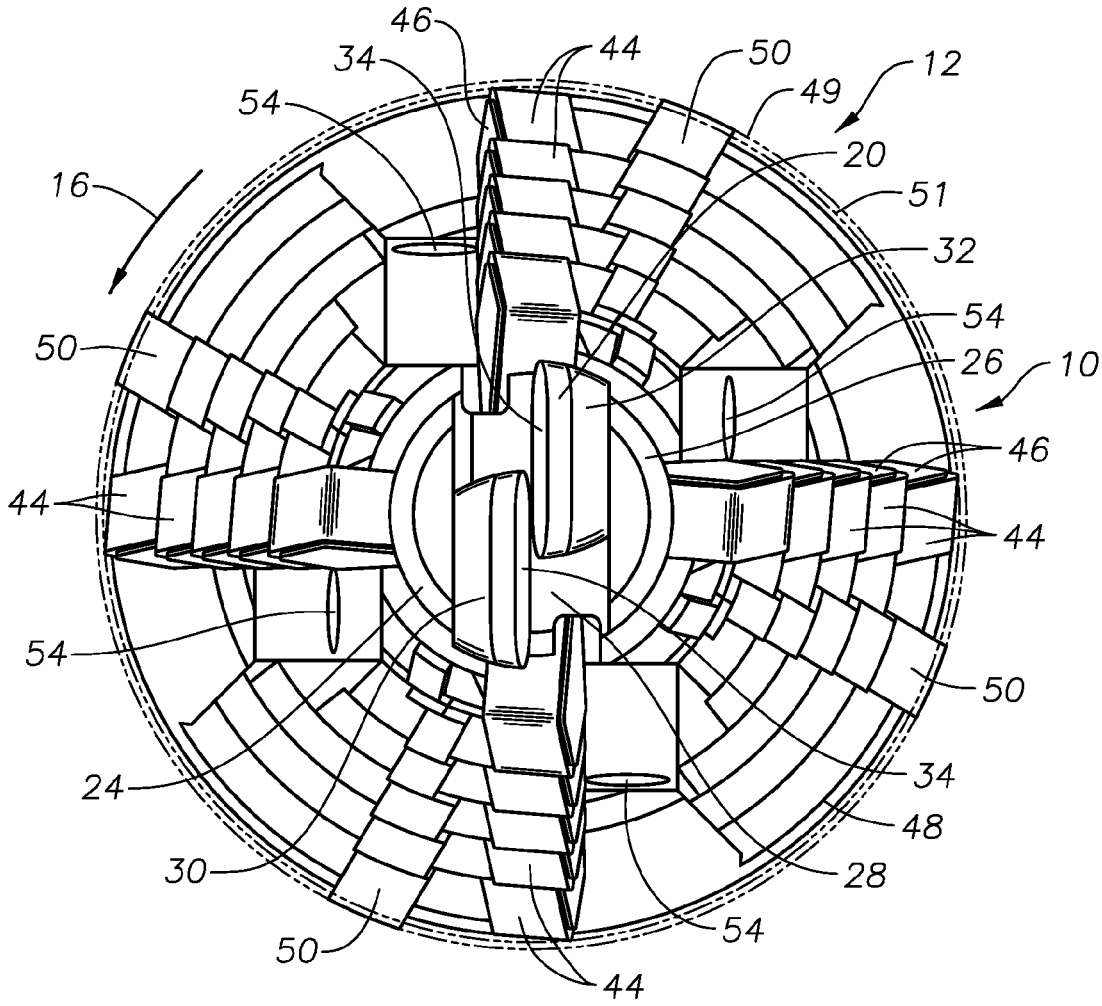
FIG. 2 is an end view of the milling tool shown in FIG. 1.
Figure 5A:
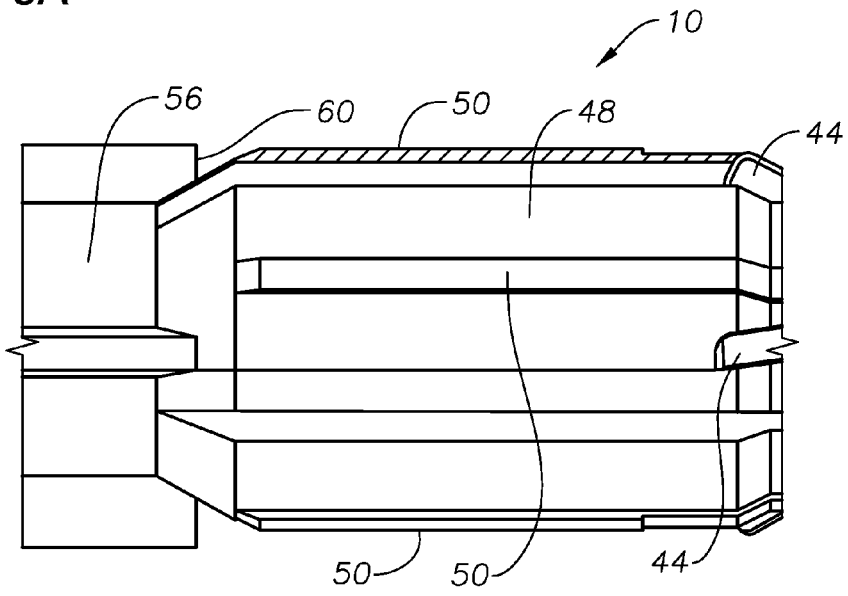
FIG. 5A is an enlarged view of a portion of FIG. 5.
Figure 5:
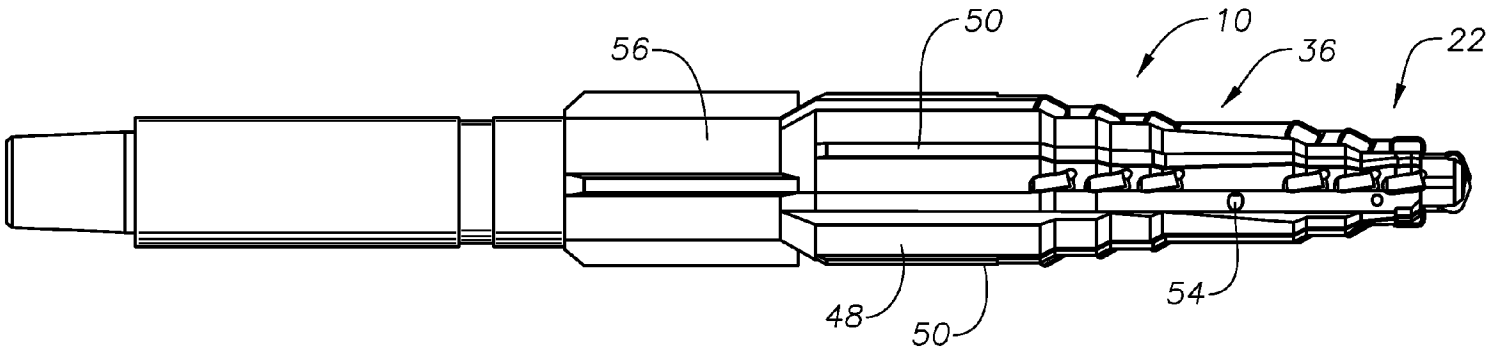
FIG. 5 is an external, side view of an exemplary milling tool in accordance with the present invention, together with a no-go centralizer sleeve.
Figure 6:
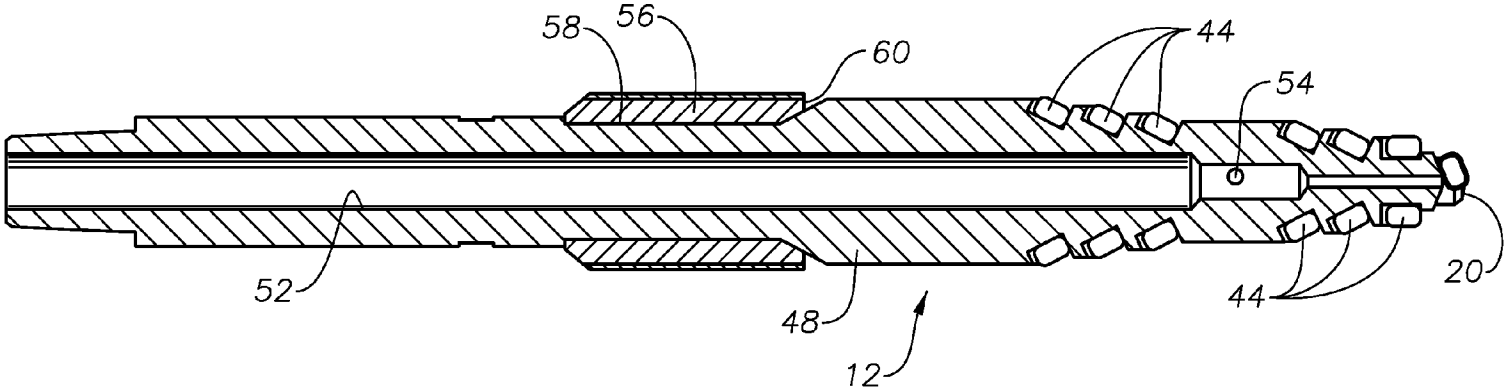
FIG. 6 is a side, cross-sectional view of the milling tool shown in FIG. 5.
Figure 7:
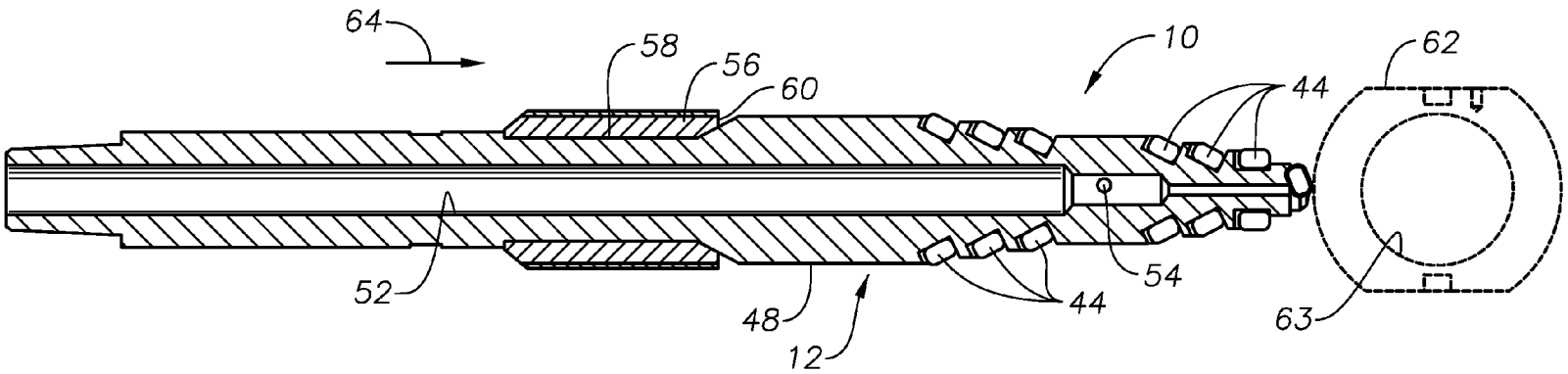
FIG. 7 is a side, cross-sectional view of the milling tool in position to begin boring through a ball of a ball valve.

Multiple stabilizing and wear pads 50 are preferably affixed to the milling tool body 12. It is preferred to use a copper alloy, or another suitable soft and erodable material, to form the pads 50. The wear pads 50 are formed of a material that is softer than the cutters 44. It is also preferred that the wear pads 50 are formed of a material that is softer than the milling tool body 12. The wear pads 50 provide a section of stabilization because they mitigate vibration-induced damage to the cutters 44 and resist motor stalling due to extreme metal-to-metal friction. It is noted that the pads 50 are generally disposed in a longitudinal axial configuration upon the milling tool body 12 including both the cutting section 36 and the shaft portion 48. As can be seen with reference to FIG. 5A, the wear pads 50 extend radially outwardly from the shaft portion 48 and extend outwardly even further than the outer cutting reach of any cutter 44. FIG. 2 illustrates that, along the shaft portion 48, the wear pads 50 provide an engagement diameter 49 that exceeds the maximum cutting diameter 51 that is provided by the cutters 44. As can also be seen especially from FIG. 2, there is preferably one pad 50 for each axial line of cutters 44. in addition, the pads 50 are placed proximate each line of cutter 44 and in a location wherein they will follow their respective cutters 44 during rotation of the milling tool 10. During operation, the pads 50 will tend to wear away since they are formed of a material that is softer than the cutters 44.

Figure 8:
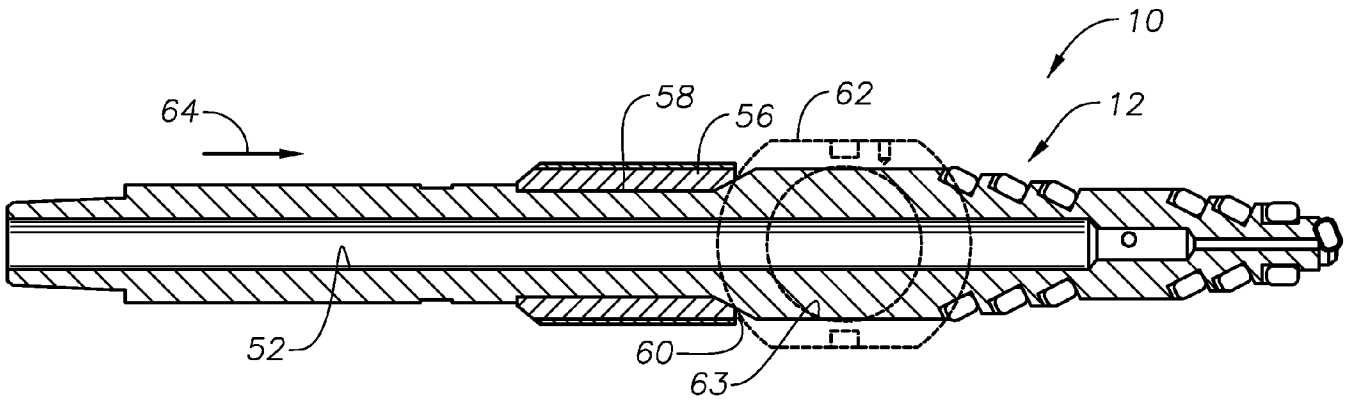
FIG. 8 is a side, cross-sectional view of the milling tool shown in FIG. 7 after having bored through the ball of the ball valve.

As can be seen in FIG. 8, the milling tool body 12 of the milling tool 10 defines a central fluid flowbore 52. When the milling tool 10 is interconnected with the mud motor, the flowbore 52 is in fluid communication with the flowbore of the mud motor so that fluid flowed down through the mud motor will enter the flowbore 52. Fluid circulation ports 54 are disposed through the milling tool body 12 to permit fluid to exit through the milling tool body 12 proximate the cutters 44 and provide lubrication to the cutters 44 as well as to flow debris and cuttings away from the cutters 44. The hole cutter 10 may be created using a numerically-controlled 5-axis manufacturing machine, of a type known in the art.

In accordance with a further feature of the present invention, a no-go centralizer sleeve 56 is preferably disposed around a reduced-diameter shaft portion 58 of the shaft portion 48 of the milling tool body 12. An exemplary no-go centralizer sleeve 56 is shown in FIGS. 5, 5A, 6, 7 and 8. The sleeve 56 presents an outer diameter that exceeds the diameter of the shaft section 48 of the milling tool body 12. The sleeve 56 presents downward-facing axial stop shoulders 60. FIG. 8 illustrates an exemplary milling tool 10 having already cut through a wellbore obstruction in the form of a ball valve ball 62. The ball valve ball 62 is in a closed position, as is known, and thereby presents a transverse opening 63. The stop shoulders 60 of the centralizer sleeve 56 is in abutting contact with the ball valve ball 62, thereby preventing further axial movement of the milling tool 10 in the direction of cutting 64. The sleeve 56 provides an indication to an operator that cutting has been completed, and also restricts further progression of the bottom hole assembly (BHA).

Figure 9:
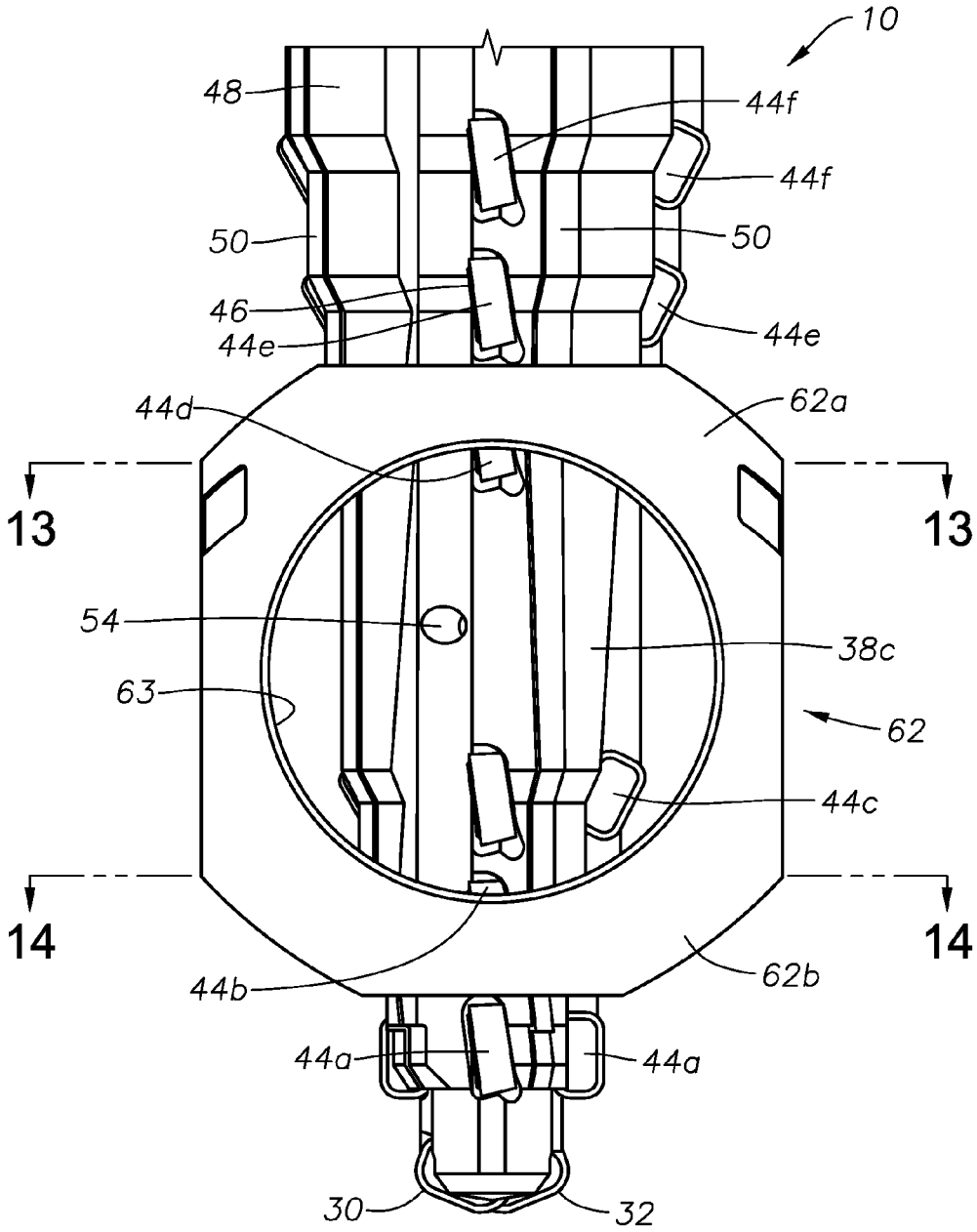
FIG. 9 is an external side view of the milling tool during cutting a hole within a ball valve ball.
Figure 10:
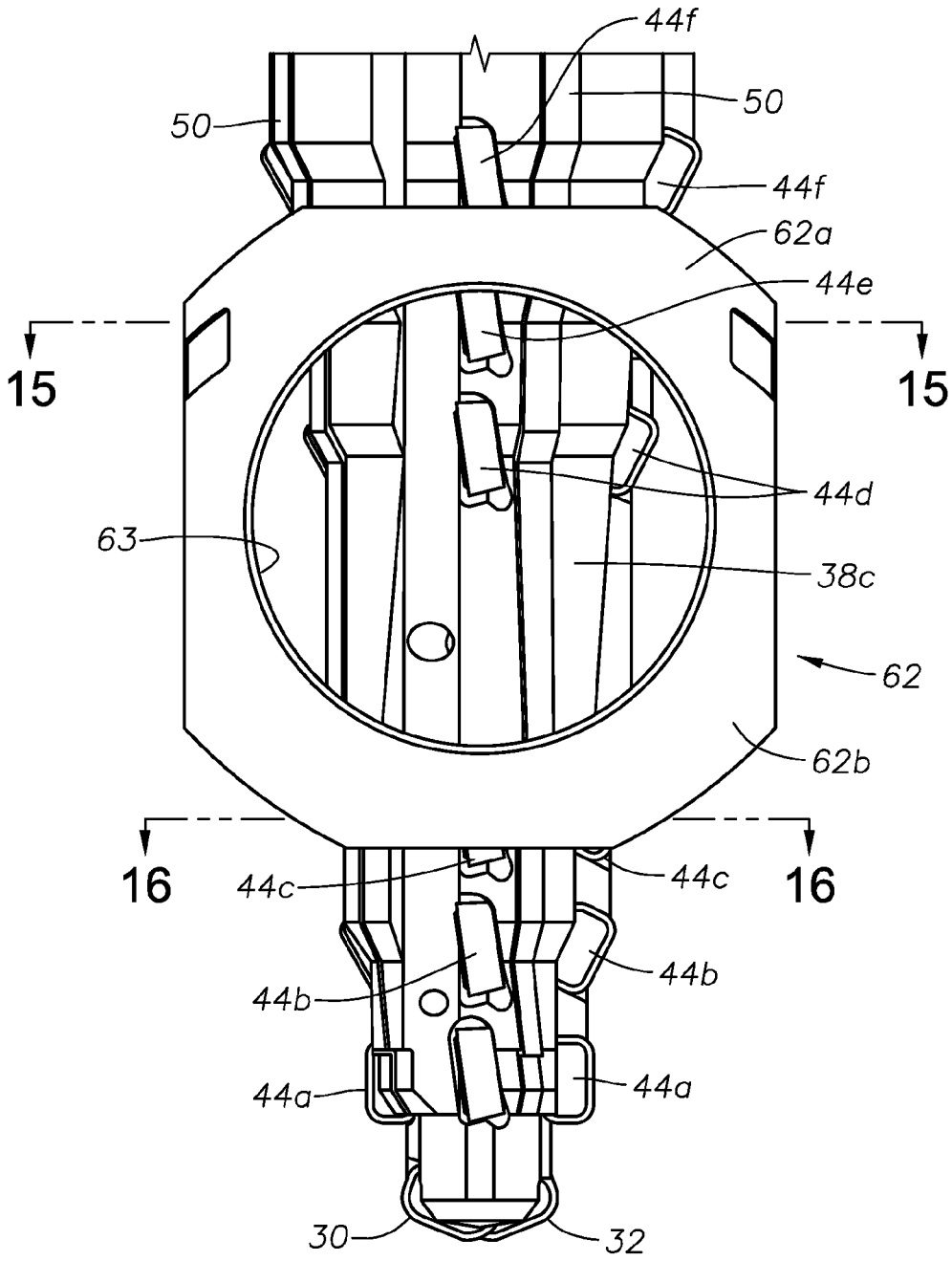
FIG. 10 is an externa side view of the milling tool now at a further point during cutting of the hole within a ball valve ball.

In operation, the milling tool 10 is operable to contact a wellbore obstruction and create a hole therein, The configuration of the milling tool 10 permits a small, initial hole or opening to be created in the obstruction which is then enlarged until the milling tool 10 has created a hole that is the desired full gage. Milling through a ball valve ball, such as ball valve ball 62, presents unique challenges due to the geometry of the valve ball and the fact that it is typically fashioned from very hard material. Milling through a ball valve ball requires cutting a hole through an upper solid portion of the valve ball (62*a* in FIG. 9), spanning a gap formed by a transverse opening (63) and then cutting through a lower solid portion of the valve ball (62*b* in FIG. 9). In one embodiment, the length of the annular portion 38*c* is long enough to avoid the adjacent cutter row 44*d* from engaging the upper solid portion 62*a* of the valve ball 62 while the nose cutters 30, 32 mill at least 90% of the way through the bottom of the valve ball 62. The increased spacing between rows of cutters 44*c* and 44*d* that is provided by annular portion 38*c* permits a relatively balanced engagement by the distal cutter rows 44*a*, 44*b*, 44*c* with the lower solid portion 62*b* of the valve ball 62 and by the proximal cutter rows 44*d*, 44*e*, 44*f* with the upper solid portion 62*a* of the valve ball 62 during intermediate portions of the milling operation.

Figure 14:
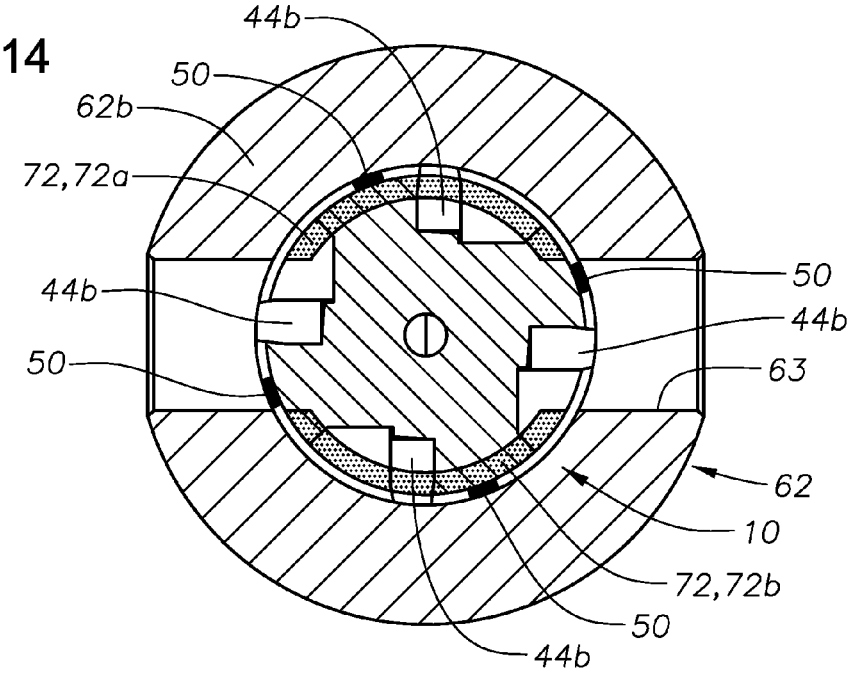
FIG. 14 is a cross-section taken along lines 14-14 in FIG. 9.

FIGS. 9, 13, 14 and 18 depict the milling tool 10 during a stage of milling through ball valve ball 62. At this point during milling, the row of cutters 44*d* is engaged in milling the upper portion 62*a* of the ball valve ball 62. A second row of cutters 44*b* is engaged in milling through a lower solid portion 62*b* of the ball valve ball 62. The cross-sectional view of F*igure* 13 illustrates a first area 70 of milling contact between the four cutters 44*d* (see FIG. 9) and the ball valve ball 62. The area 70 is made up of area portions 70*a* and 70*b* as a result of the full contact area 70 being separated by a portion of transverse opening 63. The milling contact area 70 is illustrated with close cross-hatching. FIG. 14 depicts a second area of milling contact that occurs between the four cutters 44*b* and the ball valve ball 62. Again, the milling contact area 72 is divided by the transverse opening 63 into area portions 72*a* and 72*b*. It can be seen from FIGS. 13 and 14 that the wear strips 50 are in contact with the valve ball 62 during this stage of milling.

Figure 18:
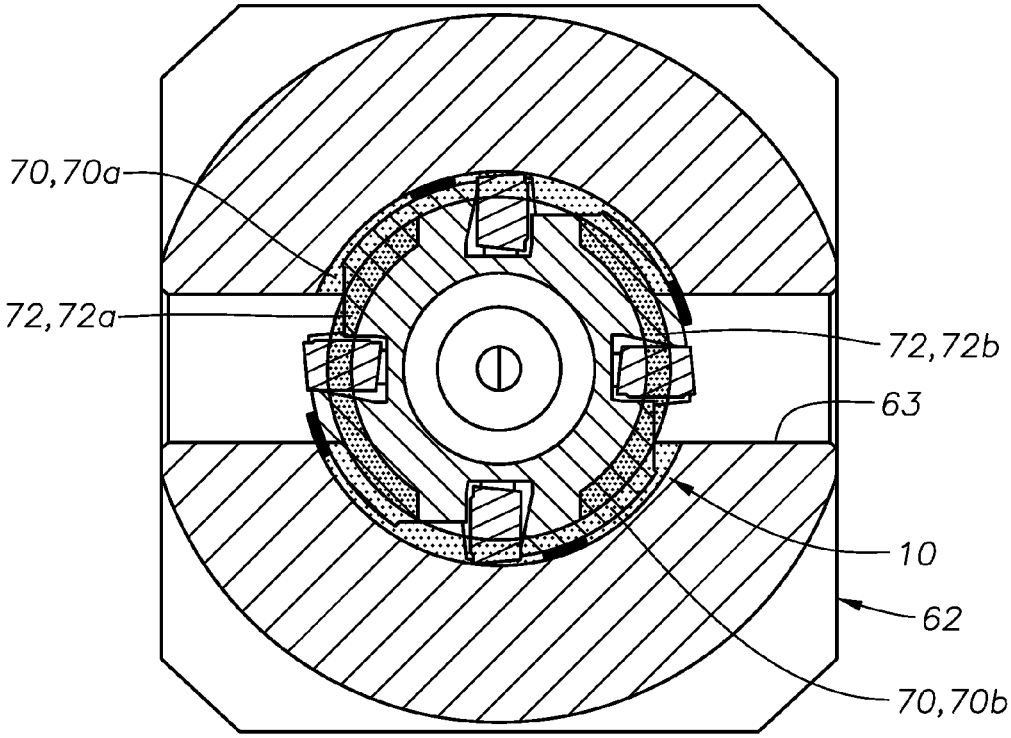
FIG. 18 is a composite of the cross-sectional views of FIGS. 13 and 14.
Figure 19:
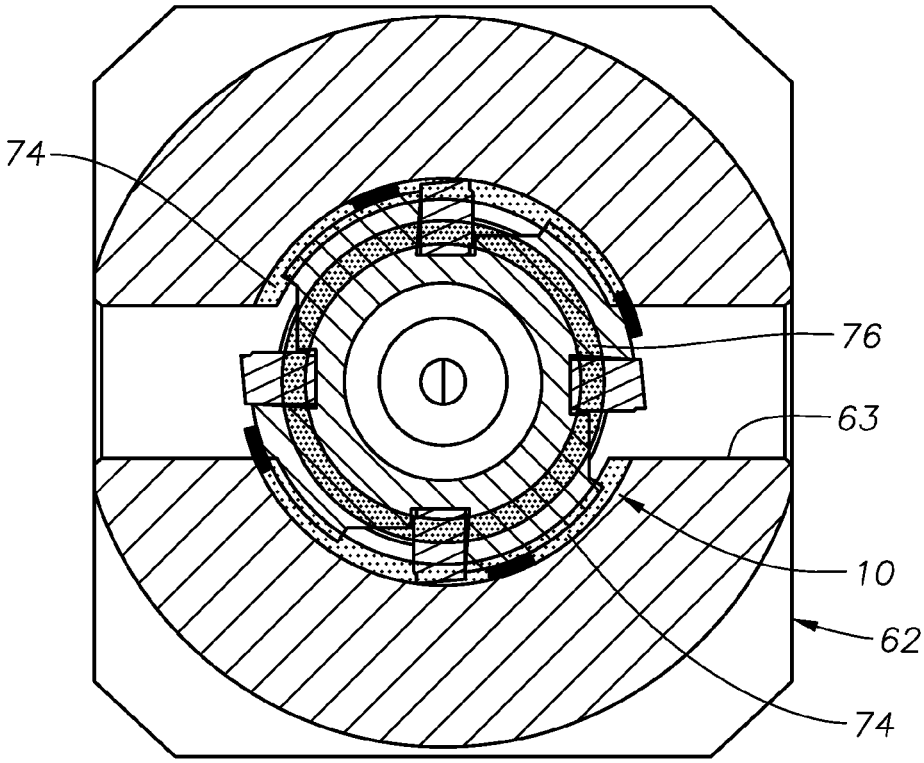
FIG. 19 is a composite of the cross-section views of FIGS. 15 and 16.

FIG. 18 illustrates the milling contact areas 70 and 72 now overlapped with area 72 shown 90° out of rotation. The combined area of the contact represents the total milling area between the milling tool 10 and the valve ball 62.

FIGS. 10, 15, 16 and 19 illustrate the milling tool 10 at a further point in milling through the valve ball 62. Cutter rows 44*d* and 44*b* have already passed through the valve ball 62. Cutter row 44*e* engages the top portion 62*a* of the valve ball 62 while cutter row 44*c* engages the bottom portion 62*b* of the valve ball 62.

Figure 15:
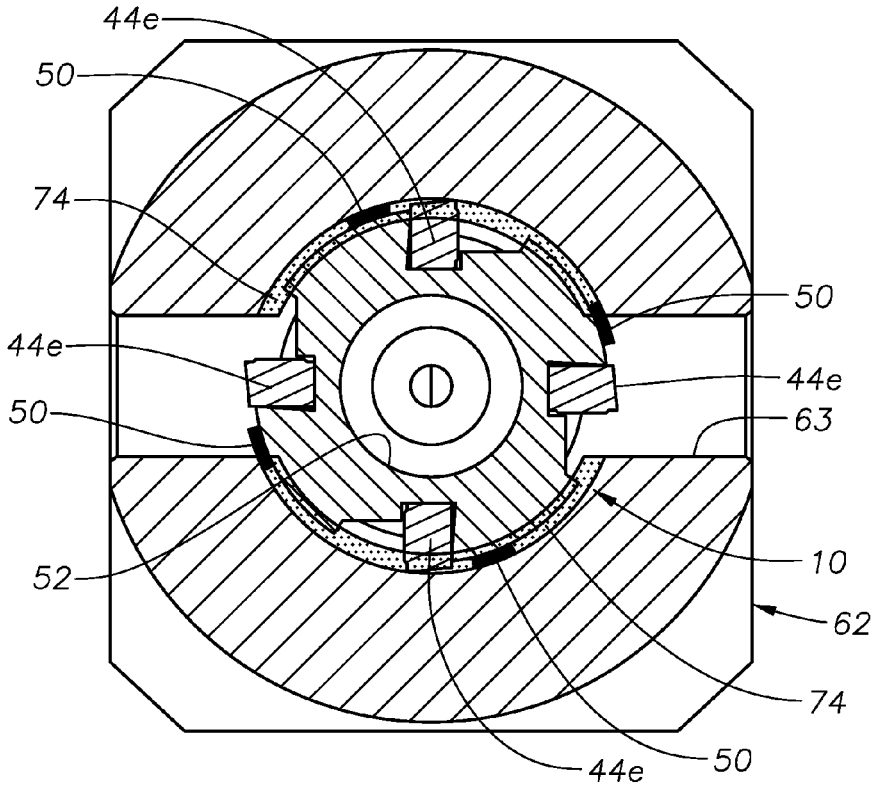
FIG. 15 is a cross-section taken along lines 15-15 in FIG. 10.
Figure 16:
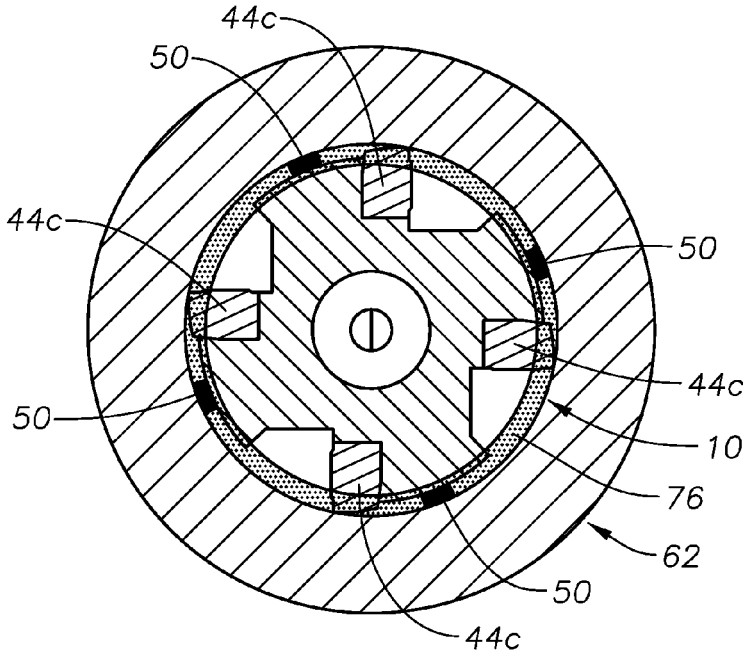
FIG. 16 is a cross-section taken along line 16-16 in FIG. 10.

FIG. 15 depicts the milling contact area 74 that is provided by the row of cutters 44*e* and the valve ball 62. The milling contact area 76 in FIG. 16 is that provided between the cutters 44*c* and the lower solid portion 62*b*. It is noted that the combined milling contact areas 70 and 72 shown in FIG. 18 are approximately equivalent to the combined milling contact areas 74 and 76 shown in FIG. 19. In some embodiments, the total milling contact area 70+72 is within 10% of the total milling contact area 74+76. In some embodiments, the total milling contact area 70+72 is within 5% of the total milling contact area 74+76. It is further noted that the substantial equivalence in the total milling contact area, resulting from the placement and number of cutters 44 and the stepped nature of the cutting section 36, holds true throughout the majority of the operation of milling through the ball valve ball 62. Because the total milling contact areas are substantially equivalent to each other during different stages of the milling operation, the milling load remains substantially constant during milling.

Figure 11:
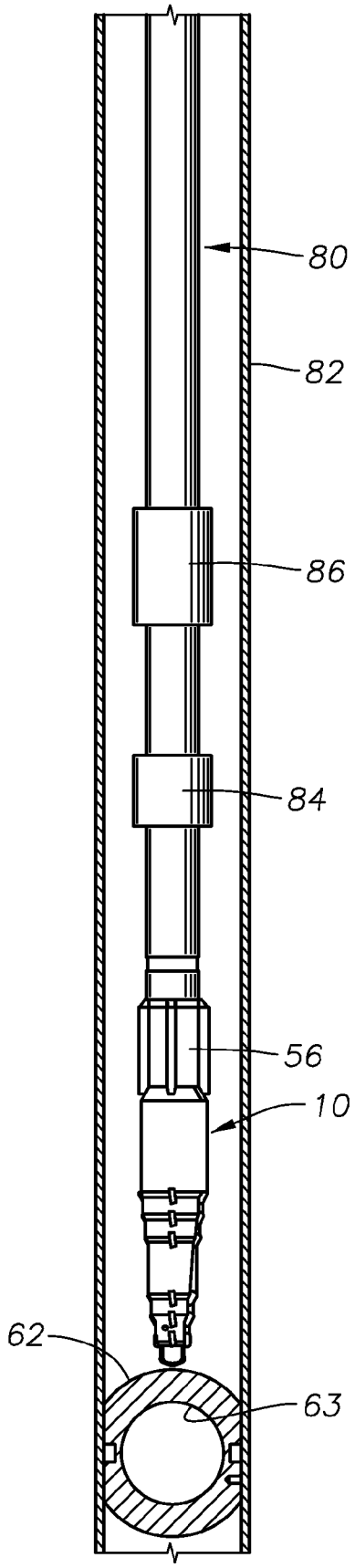
FIG. 11 illustrates an exemplary coiled tubing arrangement for running a milling tool in accordance with the present invention.

The substantially equivalent milling contact area is highly desirable when milling is conducted using a coiled tubing running string. FIG. 11 schematically depicts a coiled tubing running string 80 which is used to dispose the milling tool 10 into a wellbore 82 to mill though ball valve ball 62. A mud motor 84, of a type known in the art, is incorporated into the running string 80 to drive the milling tool 10. A weight 86 is also incorporated into the running string 80 to apply a set-down load to the milling tool 10. During milling, the coiled tubing string 80 is typically placed in tension, and the load applied to the milling tool 10 results from the weight 86. Because downward force cannot be effectively applied to a coiled tubing string, the load applied to the milling tool 10 is effectively limited to that resulting from the weight 86. Despite this substantially constant load, due to the geometry of the valve ball 62 the resistance to milling varies as the milling tool 10 bores/mills through the valve ball 62. However, it is desirable to minimize this variance to prevent damage to the milling tool 10.

Figure 12:
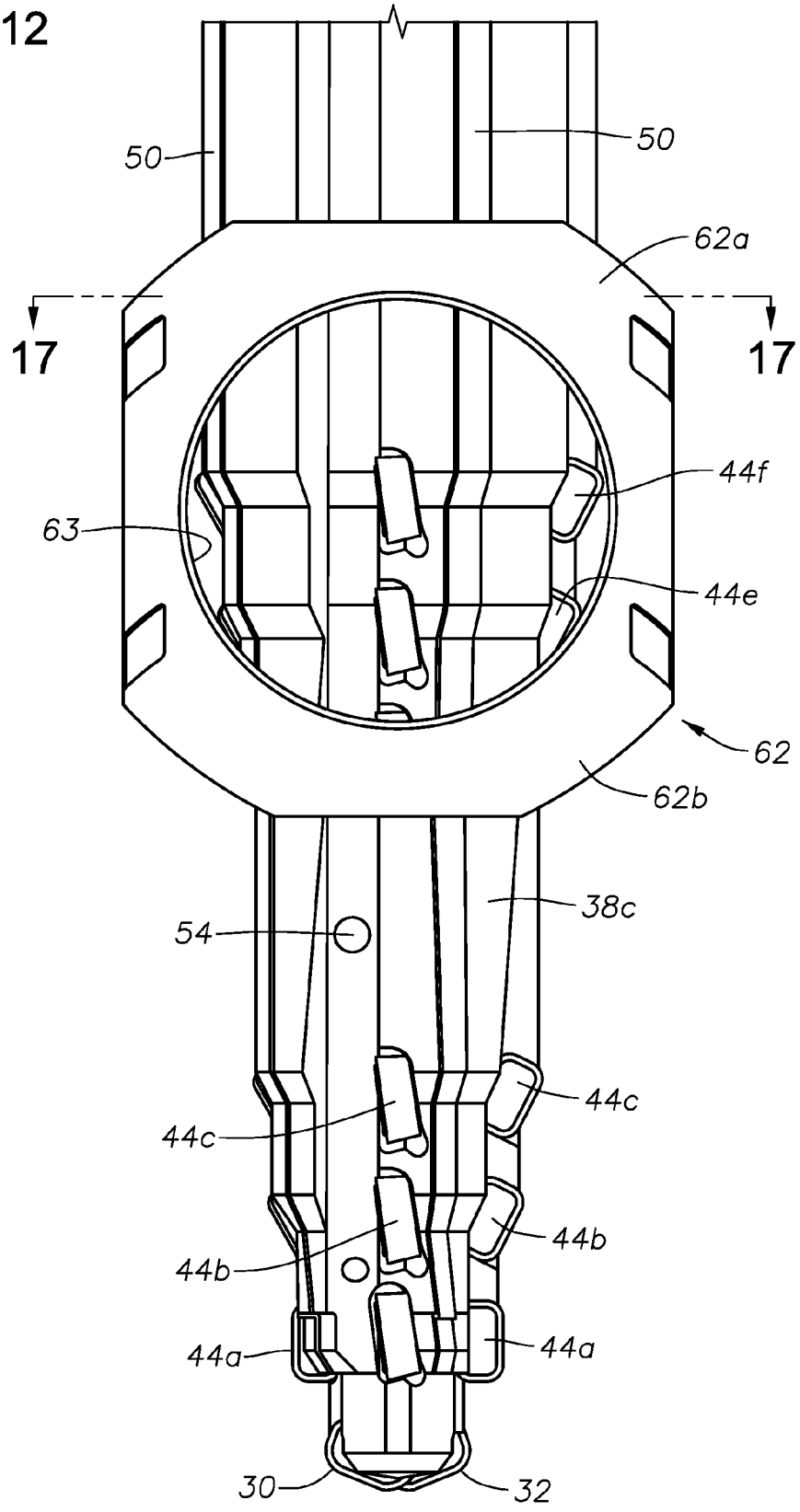
FIG. 12 is an external side view of the milling tool now at a further point during cutting of the hole within a ball valve ball.
Figure 13:
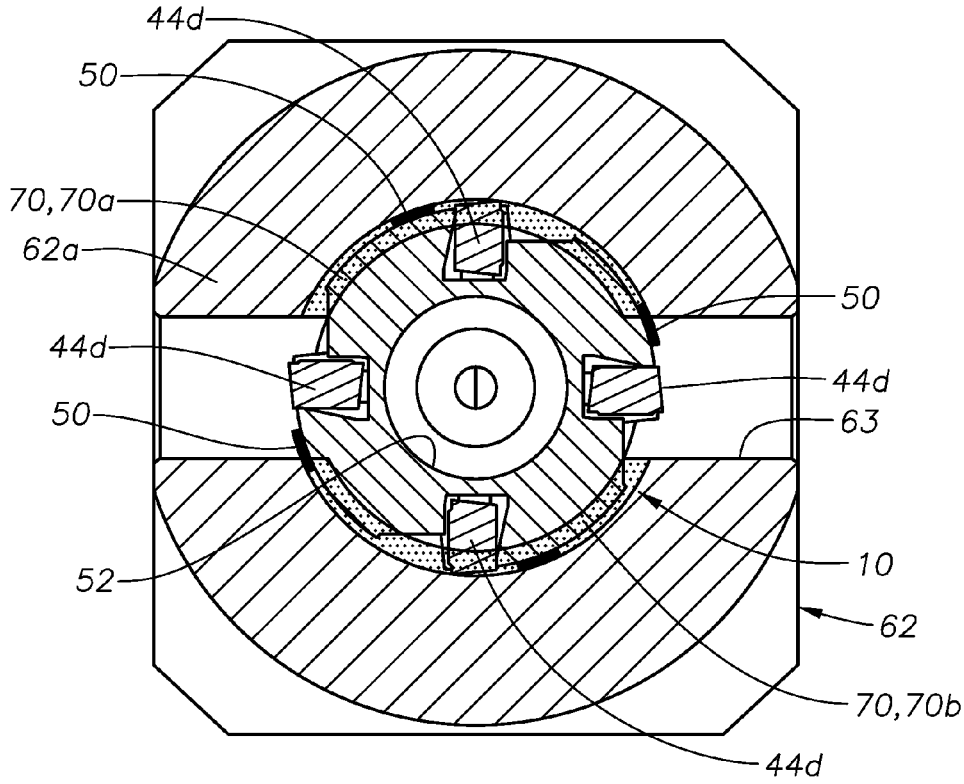
FIG. 13 is a cross-section taken along lines 13-13 in FIG. 9.
Figure 17:
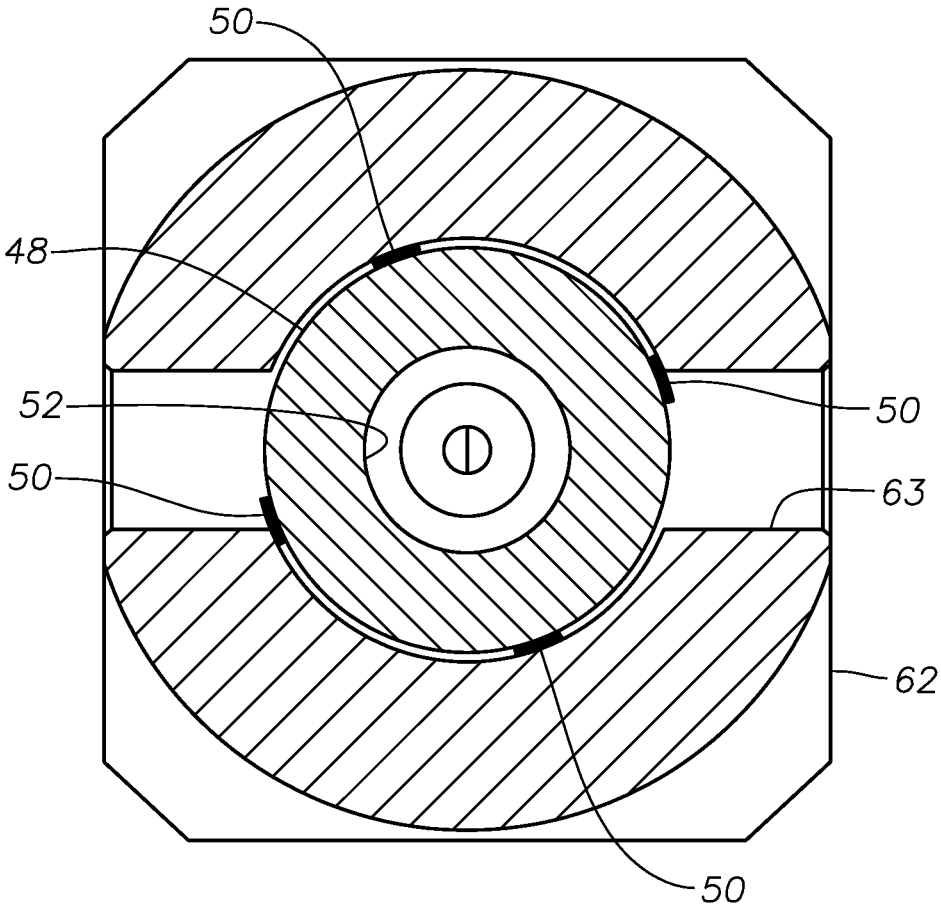
FIG. 17 is a cress-section taken along lines 17-17 in FIG. 12.

Referring now to FIGS. 12 and 17, the milling tool 10 is shown at a further point during milling through the ball valve ball 62. The shaft portion 48 is located within the upper solid portion 62*a* of the ball valve ball 62, and no cutters 44 are engaging the upper solid portion 62*a*. However, as FIG. 17 shows,the wear pads 50 contact the upper solid portion 62*a*. The contact between the wear pads 50 and the upper solid portion 62*a* provides stabilization for the milling tool 10 as it continues to mill through the lower solid portion 62*b*.

Those of skill in the art will recognize that numerous modifications and changes may be made to the exemplary designs and embodiments described herein and that the invention is limited only by the claims that follow and any equivalents thereof.

What is claimed is:

1. A milling tool for milling a hole in an obstruction within a tubular member, the apparatus comprising:

a milling tool body with a distal end and a proximal end;

a cutting section disposed on the milling tool body, the cutting section having a plurality of hardened cutters which will cut the obstruction to a maximum cutting diameter;

a shaft portion disposed proximally from the cutting ection on the milling tool body;

a wear pad disposed upon the cutting section and the shaft portion and being formed of a material that is softer than the material forming the hardened cutters, the wear pad being in engaging contact with the obstruction as the hole is milled;

the wear pad extending radially outwardly from the shaft portion to an engagement diameter that exceeds the maximum cutting diameter; and a no-go centralizer sleeve circumferentially disposed around the shaft portion, the no-go centralizer sleeve presenting a stop shoulder to provide abutting contact with the obstruction to prevent further axial movement of the milling tool body.

2. The tool of claim 1 further comprising a nose cutting portion at the distal end of the milling tool body and having:

a base; and two cutting prongs that extend distally from the base; and a hardened nose cutter affixed to each of the prongs in an offset relation, the nose cutters each presenting a wear face which is in a facing relation to the wear face of the other nose cutter.

3. The tool of claim 1, wherein the cutting section comprises:

a plurality of annular portions of sequentially increasing diameter; and the annular portions being separated from each other by angled shoulders.

4. The tool of claim 3, wherein one of said annular portions has a greater axial length than the other annular portions.

5. The tool of claim 3, wherein the cutting section further comprises:

a plurality of cutter pockets arranged adjacent to each other in an axial line along the cutting section; and wherein a hardened cutter is disposed in each cutter pocket.

6. The tool of claim 5, wherein there are multiple axial lines of cutter pockets arranged along the cutting section.

7. The tool of claim 6, wherein there are multiple wear pads secured to the milling tool body upon the cutting section and each of the wear pads is located adjacent to one of the axial lines of cutter pockets.

8. The tool of claim 5, wherein the cutters are arranged in a plurality of cutter rows upon the cutting section such that each of the cutters of a cutter row engage the obstruction in cutting along the same arc of impact.

9. The tool of claim 8 wherein:

the obstruction comprises a ball valve ball having an upper solid portion and a lower solid portion which are separated by a transverse opening; and the cutters engage the upper and lower solid portions to provide a substantially equivalent total milling contact area throughout milling.

10. A system for forming a hole in a subterranean obstruction comprising:

a tool string that is disposed into the earth;

a hole forming apparatus affixed to the tool string and comprising:

a milling tool body with a distal end and a proximal end;

a nose cutting portion at the distal end of the milling tool body, the nose cutting portion comprising at least one hardened nose cutter;

a cutting section disposed proximally from the nose cutting portion on the milling tool body, the cutting section comprising a plurality of annular portions of sequentially increasing diameter, the annular portions being separated from each other by angled shoulders;

a plurality of cutters disposed upon the cutting section and presenting a maximum cutting diameter; and a shaft portion disposed proximally from the cutting section on the milling tool body, the shaft portion having a wear pad disposed thereupon formed of wearable material and extending radially outwardly from the shaft portion to an engagement diameter that exceeds the maximum cutting diameter, the wear pad being in engaging contact with the obstruction as the hole is milled.

11. The system of claim 10, wherein:

the tool string comprises coiled tubing; and further comprising a mud motor incorporated into the tool string to rotate the hole forming apparatus in response to fluid flowed downwardly through the tool string.

12. The system of claim 10, further comprising a no-go centralizer sleeve circumferentially disposed around the shaft portion, the no-go centralizer sleeve presenting a stop shoulder to provide abutting contact with the obstruction to prevent further axial movement of the milling tool body.

13. The system of claim 10, wherein the cutting section further comprises:

a plurality of cutter pockets arranged adjacent to each other in an axial line along the cutting section; and wherein a cutter is disposed in each cutter pocket.

14. The system of claim 13, wherein there are multiple axial lines of cutter pockets arranged along the cutting section.

15. The system of claim 13, wherein the wear pad is secured to the milling tool body in an axial line upon the cutting section and adjacent to the axial line of cutter pockets, the wear pad being formed of a material that is softer than the material forming the cutters.

16. A method of milling a hole within an obstruction within a tubular member comprising the steps of:

disposing into the tubular member a tool string having a milling tool comprising:

a) a milling tool body with a distal end and a proximal end;

b) a cutting section disposed on the milling tool body, the cutting section having a plurality of hardened cutters which will cut the obstruction to a maximum cutting diameter;

c) a shaft portion disposed proximally from the cutting section on the milling tool body;

d) a wear pad disposed upon the cutting section and the shaft portion and being formed of a wearable material that is softer than the material forming the cutters, the wear pad extending radially outwardly from the shaft portion to an engagement diameter that exceeds the maximum cutting diameter, the wear pad being in engaging contact with the obstruction as the hole is milled;

contacting the obstruction with the milling tool;

rotating the milling tool to cause the cutting section to cut a hole in the obstruction to a maximum cutting diameter;

disposing the shaft portion within a portion of the obstruction so that the wear pad contacts the obstruction at said engagement diameter to stabilize the milling tool; and halting axial progression of the milling tool through the obstruction by engaging the obstruction with a stop shoulder on the milling tool.

17. The method of claim 16, wherein:

the obstruction comprises a ball valve ball having an upper solid portion and a lower solid portion which are separated by a transverse opening;

the portion of the obstruction within which the shaft portion is disposed is the upper solid portion.

* * * * *